United States Patent [19]

Egger

[11] 4,275,836

[45] Jun. 30, 1981

[54] METHOD AND APPARATUS FOR SPRAYING CONCRETE

[75] Inventor: Hansruedi Egger, Zumikon, Switzerland

[73] Assignee: Intradym Maschinen AG, Winterthur, Switzerland

[21] Appl. No.: 75,988

[22] Filed: Sep. 17, 1979

[30] Foreign Application Priority Data

Sep. 22, 1978 [CH] Switzerland ..... 9927/78

[51] Int. Cl.[3] ..... B05B 9/00

[52] U.S. Cl. ..... 239/124; 366/40; 406/84

[58] Field of Search ..... 239/124, 8, 9, 10, 418, 239/61; 406/83, 84, 48; 222/630, 637; 221/278; 366/5, 10, 11, 13, 36, 40

[56] References Cited

U.S. PATENT DOCUMENTS

| | | | |
|---|---|---|---|
| 2,014,708 | 9/1935 | Vawter | 366/11 X |
| 2,880,976 | 4/1959 | Troe | 239/124 X |
| 3,096,968 | 7/1963 | Kempthorne | 406/48 X |
| 3,237,881 | 3/1966 | Grosswiller et al. | 406/111 X |
| 3,838,847 | 10/1974 | Tegelhutter | 366/40 X |

FOREIGN PATENT DOCUMENTS

| | | | |
|---|---|---|---|
| 1005129 | 9/1965 | United Kingdom | 406/84 |

*Primary Examiner*—Robert B. Reeves
*Assistant Examiner*—Gene A. Church
*Attorney, Agent, or Firm*—Werner W. Kleeman

[57] ABSTRACT

To reduce the impact velocity of the concrete mass upon a surface, such as a wall, a branch line is arranged at the concrete conveying hose and at a point removed from the spraying nozzle. The branch line is intended to carry compressed air and opens into the surroundings. This branch line has a valve for regulating the quantity of compressed air which is to be withdrawn. By means of the branch or withdrawal line there is appreciably reduced the rebound of the concrete mass at the wall. The concrete mixture is initially pre-moistened to a constant moisture content before it arrives along the spraying or injection path and at the spraying or injection nozzle there is added thereto a constant residual water quantity. This method affords a continuously constant water content and renders possible reduced pressure of the conveying air since the concrete mixture is only pre-moistened at the conveying path.

9 Claims, 1 Drawing Figure

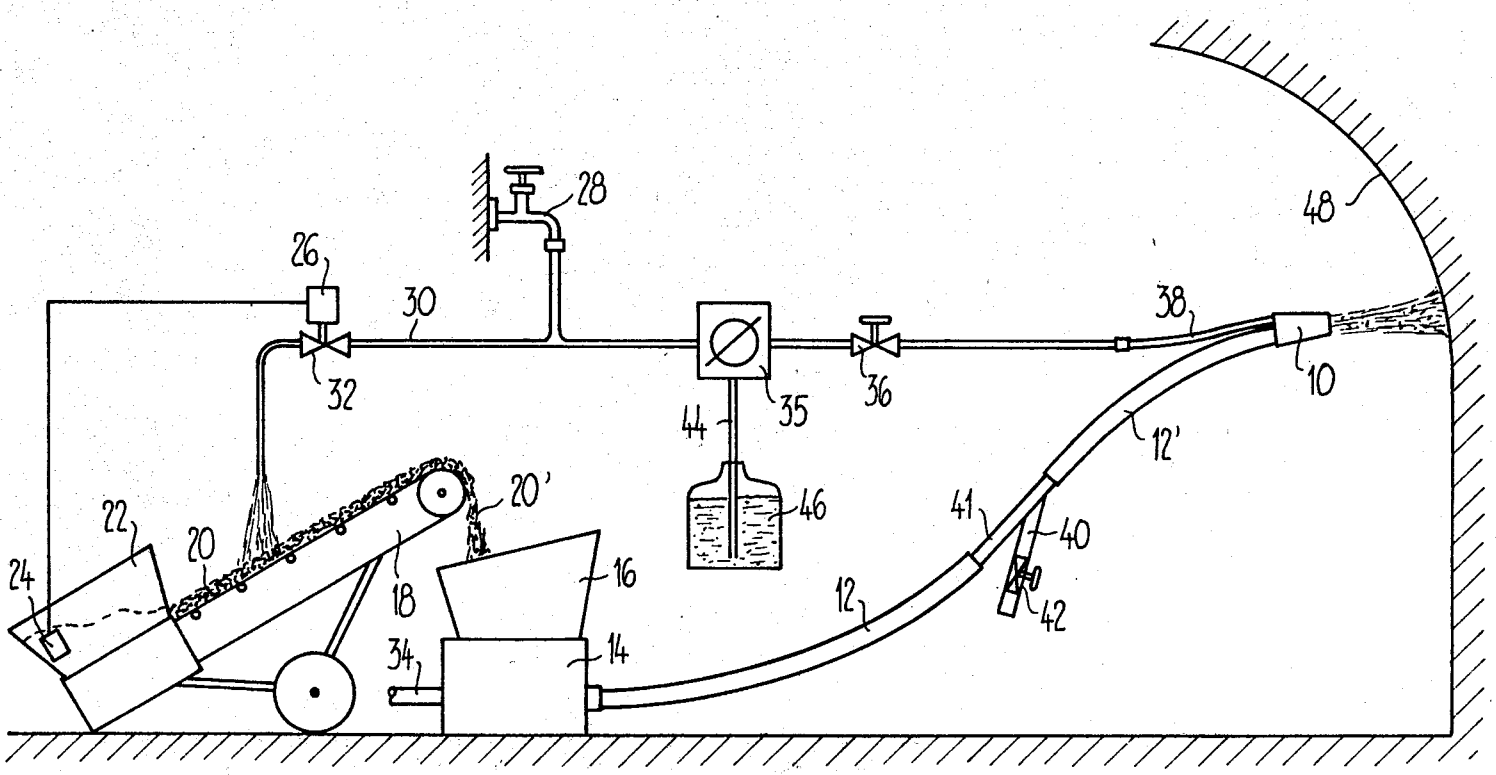
48
10
38
12'
40
42
41
12
36
35
46
44
28
16
14
20'
18
34
30
32
26
20
22
24

METHOD AND APPARATUS FOR SPRAYING CONCRETE

BACKGROUND OF THE INVENTION

The present invention relates to a new and improved method of spraying or injecting concrete, and furthermore, pertains to novel apparatus for the performance of the aforementioned method.

Generally speaking, the method of spraying concrete as contemplated by the invention utilizes compressed air, wherein a dry mixture composed of cement and additives has added thereto water and at least part of the compressed air, serving as the conveying medium, is withdrawn from the conveying path before the sprayable material departs from a spray nozzle.

This type of method serves for application of concrete to a substrate, such as a wall or an arch, for instance in galleries, during tunnel construction and in mines. The compressed air serving as a conveying medium must have an adequate pressure in order to be able to convey the concrete mass through a conveying path from a spraying or injection machine up to the spraying or injection nozzle. If the concrete mass has incorporated therein an adequate quantity of water, already forwardly of such conveying path, then the volumetric weight of the concrete mass is greater than that of a dry concrete mass. Additionally, the friction in the conveying path increases owing to the tackiness of the mass, so that the compressed air must be at such a high pressure that there can be positively avoided clogging of the conveying hose serving as the conveying path.

Yet, the high pressure of the conveying air causes the concrete mass, emanating from the injection nozzle, to be propelled against the support surface or substrate with such a great force that an appreciable amount of the sprayed concrete mass rebounds or splatters back from the support surface or substrate and drops to the ground as unusable material and as undesirable waste. The economies of the spraying or injection method are appreciably impaired due to the loss of part of the concrete mass, since this waste proportion can be quite appreciable in terms of the entire amount of concrete mass which is to be sprayed.

On the other hand, if the concrete mass is conveyed up to the region of the spray nozzle in an almost dry state and the requisite quantity of water is first added at the location of the spray nozzle, then while there is adequate lesser pressure of the conveying air, nonetheless the time of action of the water at the concrete mass is too short, so that the adherence of the concrete mass at the support surface is rendered more difficult due to inadequate tackiness. Additionally, there is considerable dust formation which can appreciably impair visibility.

Moreover, the rebound of the concrete at the support surface is further augmented by the action of the compressed air which effluxes together with the concrete mass out of the spray nozzle, in that the concrete mass is again blow-off of the support surface. Therefore, it is known to the art to separate part of the compressed air from the concrete mass directly at or shortly ahead of the spray or injection nozzle and to outfeed such to the surrounding atmosphere. The withdrawal or branching-off of part of the compressed air occurs directly at the spray nozzle. One prior art construction of spray nozzle is curved and at the inside of the arc or curve has an air withdrawal opening. A pressure equalization between the interior of the spray nozzle and the surrounding atmosphere takes place through this opening. Consequently, the concrete mass flows, by virtue of the centrifugal force, along the outer surface of the curve or arc.

According to another proposal the nozzle is formed of two tubes. The outer tube is tapered in a funnel-shaped manner, whereas the inner tube opens into this funnel-like tube, similar to an injector. The funnel or funnel-like tube is open at the rear side, with respect to the spraying or injection direction, whereas its front side forms the mouth of the spray nozzle. The material jet is propelled through the funnel or nozzle mouth, owing to the high kinetic energy, whereas a part of the conveying air can escape towards the rear.

Notwithstanding the use of the previously described spray nozzles the concrete mass is propelled with the full kinetic energy upon the support surface or subtrate, producing the drawbacks which have already been discussed above. Furthermore, the spray nozzles designed according to the aforementioned proposals are both heavy and cumbersome to use.

SUMMARY OF THE INVENTION

Therefore, with the foregoing in mind it is a primary object of the present invention to provide a new and improved method of, and apparatus for, spraying concrete in a manner not associated with the aforementioned drawbacks and limitations of the prior art proposals.

Another and more specific object of the present invention is directed to the provision of a new and improved method of spraying concrete wherein the rebound of concrete mass from the surface is limited to a minimum.

Yet a further significant object of the present invention is to devise a new and improved construction of concrete spraying apparatus which is relatively simple in design, economical to manufacture, extremely reliable in operation, and provides for more efficient and effective spraying of the concrete mass with reduced rebound of the sprayed concrete mass from the surface at which it is applied.

Now in order to implement these and still further objects of the invention, which will become more readily apparent as the description proceeds, the concrete spraying method of the present development is manifested by the features that the mixture is pre-moistened to an at least approximately constant moisture content, the pre-moistened mixture has added thereto, directly at the spray nozzle, a constant quantity of water, and the compressed air which is to be withdrawn is branched-off forwardly of a conveying path serving as a braking path along the path to the spray nozzle.

This method renders possible, on the one hand, a faultless conveying of the concrete mass which is to be sprayed or injected, and, on the other hand, by appropriately dimensioning the braking path as well as the quantity of the conveying air which is to be branched-off there can be obtained a random reduction of the kinetic energy of the concrete mass effluxing from the spray nozzle. The pre-moistened concrete mass requires a somewhat increased pressure of the conveying air, which however is again rendered completely ineffectual by virtue of the described method. Due to the pre-moistening operation there is however insured that the concrete mass already has a good moisture content, so that at the region of the spray nozzle there only must be added a residual water quantity.

As mentioned above, the invention is not only concerned with the aforementioned method aspects but also pertains to apparatus for the practice thereof. The concrete spraying apparatus comprises a conveying and spraying apparatus for the concrete mass. A moisture feeler for measuring the water content of the concrete mass is arranged along the conveying path of the concrete mass and is connected with a dosing device for water which is to be infed to the concrete mass.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically illustrates an exemplary embodiment of concrete spraying apparatus useful for the practice of the method of the invention.

DETAILED DESCRIPTION OF THE PREFERRED EMBODIMENTS

Describing now the single FIGURE of the drawing, there is shown therein an apparatus or installation for spraying concrete. In particular, there will be recognized a spray or injection nozzle 10 which is connected by means of a conveying hose or hose means 12, 12' with a spraying or injection machine 14. This spraying machine 14 will be seen to comprise a catch or receiving container 16 into which there is conveyed, by means of a band conveyor 18, concrete mass 20'. In a catch or receiving container 22 of the band conveyor 18 there is arranged a moisture measuring feeler 24 for measuring the moisture or water content of the dry mixture 20 which is filled into the catch or receiving container or funnel 22 and composed of cement and additives.

In response to the moisture of the dry mixture 20, measured by the moisture feeler or sensor 24, an adjustment element 26 is appropriately controlled. This adjustment or setting element 26 adjusts a valve 32 or equivalent structure which is connected with a water connection or line 28 by means of a water conduit or line 30. By means of the control valve 32 there is infed water to the dry mixture 20. Dosing of the infed quantity of water is accomplished as a function of the moisture content of the dry mixture 20, as measured by the moisture feeler or sensor 24, so that the moistened mixture or concrete mass 20' always possesses a more or less constant water content. The correlation between the measured moisture and the infed quantity of water is undertaken such that the water content of the concrete mass 20' amounts to, for instance, five percent or six percent.

From the spray or injection machine 14 the pre-moistened or pre-wetted concrete mass 20' is conveyed through the conveying hose means 12, 12' to the spray or injection nozzle 10, by means of compressed air which is infed via a connection or line 34 or equivalent structure. The spray nozzle 10 is operatively connected with the water connection or infeed means 28 by means of a dosing pump 35, an adjustable water valve 36 and a hose line or conduit 38. By means of a suction line or conduit 44 the dosing pump 35 sucks-up a liquid high-speed binder from a container 46 and admixes thereto water in a dosed quantity. The water containing the high-speed or rapid binder, infed to the spray nozzle 10, is added to the concrete mass 20' during the concrete spraying op ·ation. The water quantity which is set at the water valve 36 is maintained essentially constant. Since the concrete mass 20' already has been pre-moistened to an essentially constant value and also the conveyed quantity, delivered through the spray nozzle 10, is at least approximately constant, the sprayed concrete mass contains an at least approximately constant water content. The amount of such water content can be set at the water valve 36 or equivalent regulating means. It is no longer necessary to influence the quantity of water which is to be infed by the nozzle guide.

A branch or withdrawal line or section 40, defining a compressed air-exhaust line, is arranged at a pipe or conduit intermediate piece 41 which is incorporated at the concrete conveyor hose or feed line 12, 12' at a point removed from the spray nozzle 10. This branch or withdrawal section or line 40 will be seen to comprise a tubular or pipe portion which is directed rearwardly, in relation to the concrete conveying direction, preferably at an angle of about 45° and the throughpass cross-section or flow passage of such branch or withdrawal line or section 40 can be throttled by means of a regulating or adjustment valve 42 or equivalent structure. By means of the branch or withdrawal line 40 it is possible to exhaust an adjustable quantity of compressed air into the atmosphere and which serves as the conveying means for the concrete mass 20'. The branched tubular or pipe section 40 therefore is directed rearwardly in order to prevent the escape of the conveyed concrete mass 20' which flows through the feed or hose means 12, 12'. This concrete mass 20' flows further through the feed line or conduit 12, by virtue of the kinetic energy which is imparted thereto, wherein, however, due to inadequate propulsion drive by the compressed air and friction at the hose walls such concrete mass is braked. Consequently, the conveying or feed hose, at the region between the branch portion 40 and the spray nozzle 10, can be designated as the braking path. Due to the braking action the concrete mass, effluxing from the spray nozzle 10, has a lesser kinetic energy, so that the sprayed concrete mass no longer has any appreciable part thereof rebounding from the surface or support 48 upon which such concrete mass is sprayed. Consequently, there is appreciably reduced the heretofore unavoidable losses of concrete mass due to rebound or splattering of such concrete mass at the sprayed surface.

The pre-moistening of the dry mixture, accomplished at the band conveyor 18, renders possible a continuous and uniform moistening of the dry mixture, so that the concrete mass 20' is properly imbued with water. This pre-moistening to a water content of about five percent or six percent is however, on the other hand, still so slight that there is not unnecessarily impeded conveying of such concrete mass 20' along the conveying path between the spray machine 14 and the spray nozzle 10. Hence, by virtue of the pre-wetted or pre-moistened concrete mass 20' there is insured that the residual quantity of water, introduced at the spray nozzle 10, will be properly taken-up by the concrete mass since such is already adequately imbued. Due to the thus subdivided water infeed there are obtained at least two noteworthy advantages. Firstly, the requisite pressure of the conveying air can be lower than if it were otherwise necessary to convey or feed a concrete mass which has been completely wetted or moistened. Secondly, the further moistening of the concrete mass at the spray nozzle does not have the same drawbacks as the moistening of a mixture which is dry up to this location, because the mixture then would not be adequately wetted by the time it impacts against the support or substrate, and therefore, would adhere with greater difficulty at such support or substrate.

The high-speed or rapid binder which is added to the residual water quantity insures for a rapid setting of the concrete mass which has been sprayed onto the support surface or substrate 48.

The previously mentioned measures serve to reduce the loss in concrete mass due to rebound at the sprayed surface or substrate 48. Owing to the thus improved economies of the aforementioned method it is possible to add to the concrete mixture 20', prior to filling the same into the receiving container 16 of the spray machine 14, fiber-like metallic particles which improve the quality of the concrete.

According to a preferred embodiment the spacing of the branch portion 40 from the spray nozzle 10 can amount to about one to three meters.

Instead of measuring the moisture of the dry mixture, it is also possible to measure the moisture of the already pre-moistened concrete mixture at the catch or receiving container 16 of the spray machine and to regulate, instead of control, the moistening of the concrete at the band conveyor 18.

Instead of using the band conveyor 18 it would also be possible to use a different conveyor system for the concrete, for instance also a worm conveyor.

The pre-moistening of the injection concrete to a constant moisture content has, in conjunction with the use of a liquid high-speed binder, the further advantage that such can be added, together with the residual water, in a constant quantity to the injection concrete which is optimumly effective.

While there are shown and described present preferred embodiments of the invention, it is to be distinctly understood that the invention is not limited thereto, but may be otherwise variously embodied and practiced within the scope of the following claims. Accordingly,

What I claim is:

1. A method of spraying concrete by means of compressed air, comprising the steps of:

pre-moistening a mixture composed of cement and additives with an at least approximately constant moisture content;

feeding the mixture in a continuous stream by means of compressed air along a conveying path to a spray nozzle for spraying thereof;

adding to the pre-moistened mixture, directly at the region of the spray nozzle, an essentially constant quantity of water; and exhausting at least part of the compressed air serving as the conveying medium, continuously and concurrently with the continuous spraying of the mixture, out of the conveying path forwardly of part of the conveying path serving as a braking path for the continuously fed mixture stream along the path to the spray nozzle.

2. The method as defined in claim 1, further including the steps of:

feeding the mixture upon a continuously conveying-conveyor element; and pre-moistening the mixture during its transport upon said continuously conveying-conveyor element.

3. The method as defined in claim 2, further including the steps of:

measuring the moisture content of the dry mixture in a first receiving container arranged in front of the conveyor element;

obtaining a measurement result from such moisture measurement; and controlling an adjustment element which influences the quantity of water used for pre-moistening based upon the measurement result.

4. The method as defined in claim 2, further including the steps of:

measuring the moisture content of the pre-moistened mixture in a second receiving container operatively associated with a spraying machine for the concrete;

obtaining a measurement result by virtue of such measurement; and controlling an adjustment element influencing the quantity of water used for the pre-moistening operation based upon such measurement result.

5. The method as defined in claim 1, further including the steps of:

pre-moistening the mixture to a moisture content of about six percent.

6. The method as defined in claim 1, further including the steps of:

adjusting the exhausted quantity of compressed air.

7. The method as defined in claim 1, further including the steps of:

adding a high-speed binder to the water which is infed to the spray nozzle.

8. An apparatus for spraying concrete by means of compressed air, comprising:

means for conveying a concrete mass in a continuous stream along a predetermined path of travel;

means cooperating with said conveying means for spraying the conveyed concrete mass;

moisture feeler means for measuring the water content of the concrete mass;

said moisture feeler means being arranged along the conveying path of the concrete mass;

a dosing device for infeeding water to the concrete mass operatively connected with said moisture feeler means;

said concrete conveying means comprising a spraying machine including means for infeeding compressed air for conveying the concrete mass;

said spraying means including a spray nozzle operatively connected by means of a conveying hose with the spraying machine;

compressed air-exhaust means defining a branch-off location arranged along the conveying path of the concrete mass and serving to exhaust compressed air into the surroundings continuously and concurrently with the spraying of the concrete mass;

said branch-off location being spaced from said spray nozzle and arranged at the conveying hose;

said conveying hose including a portion extending between said branch-off location and said spray nozzle which defines a braking path for the concrete mass in order to decelerate the same for controlling application of the sprayed concrete mass onto a surface; and said branch-off location having an adjustable opening.

9. The apparatus as defined in claim 8, wherein:

said branch-off location includes a tubular intermediate section which is incorporated into the conveying hose for the concrete;

a tube section serving as a branch-off portion operatively connected with said tubular intermediate section;

said tubular section extending rearwardly with respect to the conveying direction of the concrete mass; and said tubular section having a throttle element.

* * * * *